US009506171B2

(12) United States Patent
Nitta et al.

(10) Patent No.: US 9,506,171 B2
(45) Date of Patent: Nov. 29, 2016

(54) BEAD WEAVING TOOL

(71) Applicant: CLOVER MFG. CO., LTD., Osaka-shi, Osaka (JP)

(72) Inventors: Kumiko Nitta, Osaka (JP); Mariko Yamaguchi, Osaka (JP)

(73) Assignee: CLOVER MFG. CO., LTD., Osaka (JP)

( * ) Notice: Subject to any disclaimer, the term of this patent is extended or adjusted under 35 U.S.C. 154(b) by 0 days.

(21) Appl. No.: 14/704,277

(22) Filed: May 5, 2015

(65) Prior Publication Data

US 2015/0337466 A1 Nov. 26, 2015

(30) Foreign Application Priority Data

May 20, 2014 (JP) ..... 2014-104704

(51) Int. Cl.
*D03D 29/00* (2006.01)
*D03D 41/00* (2006.01)
*D03D 13/00* (2006.01)

(52) U.S. Cl.
CPC ..... *D03D 29/00* (2013.01); *D03D 41/00* (2013.01)

(58) Field of Classification Search
CPC ..... D03D 29/00; D04B 3/00; D04B 5/00; D04B 35/02; D04D 1/04; D04D 7/04; D05B 91/10; D05B 97/12; D05C 1/02; B44C 5/00; G09B 19/20
See application file for complete search history.

(56) References Cited

U.S. PATENT DOCUMENTS 737,073 A * 8/1903 Bush ..... D03D 29/00 139/29
829,474 A * 8/1906 Hooper ..... D03D 29/00 139/33
1,160,132 A * 11/1915 Bliss ..... D03D 29/00 139/33
1,277,927 A * 9/1918 Heiss ..... D04B 17/00 139/33.5
2,139,879 A * 12/1938 Clark ..... D03D 29/00 139/33
2,190,813 A * 2/1940 Walker ..... D03D 29/00 139/34
2,241,199 A * 5/1941 Hines ..... D03D 29/00 139/33
2,242,210 A * 5/1941 Gallinger ..... D03D 29/00 139/33

(Continued)

FOREIGN PATENT DOCUMENTS

JP 4667171 1/2011

*Primary Examiner* — Bobby Muromoto, Jr.
(74) *Attorney, Agent, or Firm* — Hamre, Schumann, Mueller & Larson, P.C.

(57) ABSTRACT

A bead weaving tool includes a plate member having a planar bead mounting surface for bead placement. The plate member has a pair of thread holding portions mutually spaced across the bead mounting surface for holding a plurality of threads separately. The plate member also has a pair of thread support walls protruding from the bead mounting surface at positions close to the thread holding portions, respectively. To hook one end and the other end of the respective threads, first and second thread hanging portions are provided.

7 Claims, 9 Drawing Sheets

(56) References Cited

U.S. PATENT DOCUMENTS 2,601,222 A * 6/1952 Wehrli ..... D03D 29/00 139/34
2,802,255 A * 8/1957 Wallach ..... D03D 29/00 139/34
3,137,320 A * 6/1964 Parton ..... D03D 29/00 139/33
3,636,987 A * 1/1972 Forby ..... D03D 29/00 28/151
3,708,839 A * 1/1973 Prince ..... D03D 29/00 28/150
3,757,395 A * 9/1973 Nepon ..... D03D 29/00 28/152
4,046,172 A * 9/1977 Russell ..... D03D 29/00 139/33
4,074,726 A * 2/1978 Harris ..... D03D 29/00 139/29
5,413,150 A * 5/1995 Townsend ..... D03D 29/00 139/34
6,149,437 A * 11/2000 Corliss ..... B44C 3/06 139/29
6,453,951 B1 * 9/2002 Kuwabara ..... D03C 9/02 139/33
D580,649 S * 11/2008 Ota ..... D3/26
7,762,284 B2 * 7/2010 Ricks ..... D04D 1/04 139/29
7,854,048 B2 * 12/2010 Ota ..... A41G 1/02 223/38
7,909,066 B2 * 3/2011 Wada ..... D03D 25/00 139/1 R
8,066,035 B1 * 11/2011 Stevens ..... D03D 29/00 139/29
8,074,384 B2 * 12/2011 Kuwabara ..... D05B 91/10 33/13
8,132,596 B2 * 3/2012 Weidler ..... D03D 29/00 139/29
9,121,117 B2 * 9/2015 Teramoto ..... D04D 1/04
2004/0055916 A1 * 3/2004 Faller ..... D04B 37/02 206/349
2004/0069363 A1 * 4/2004 D'Estais ..... D03D 29/00 139/1 R
2005/0178693 A1 * 8/2005 Gupta ..... D04D 1/04 206/574
2005/0205150 A1 * 9/2005 Jenner ..... D03D 29/00 139/11
2005/0211138 A1 * 9/2005 Gupta ..... D04D 1/04 108/43
2005/0247745 A1 * 11/2005 Spor ..... D03D 29/00 223/48
2006/0157137 A1 * 7/2006 Sayler ..... D03D 29/00 139/29
2008/0173368 A1 * 7/2008 Flodin ..... D03D 29/00 139/33
2009/0293982 A1 * 12/2009 Skaflestad ..... D04D 9/02 139/34
2010/0212770 A1 * 8/2010 Weidler ..... D04D 1/04 139/33
2011/0259465 A1 * 10/2011 Schaub ..... D03D 29/00 139/29
2012/0047960 A1 * 3/2012 Sasur ..... D04B 5/00 66/1 A
2013/0291994 A1 * 11/2013 Wijerama ..... D03D 29/00 139/29

* cited by examiner

BEAD WEAVING TOOL

BACKGROUND OF THE INVENTION

1. Field of the Invention

The present invention relates to a bead weaving tool that is to be used to manufacture beaded textiles having beads woven therein.

2. Description of Related Art

Conventionally, there are known to be bead weaving tools for manufacturing beaded textiles having beads woven therein (e.g., see Japanese Patent No. 4667171). The bead weaving tool described in Japanese Patent No. 4667171 is used in a state in which an elastically deformable plate member is curved. A thread holding portion for holding threads apart from each other is provided on each of the edge portions of the plate member. Also, mounting holes into which rod members such as toothpicks can be inserted are formed in the vicinity of the two edge portions of the plate member.

When using the bead weaving tool in Japanese Patent No. 4667171, while curving the plate member, a thread for holding the shape of the plate member is wrapped multiple times around slits that have been formed in the two edge portions as shown in FIG. 2 of Japanese Patent No. 4667171. Next, as shown in FIG. 3 of Japanese Patent No. 4667171, a plurality of threads are held apart from each other by the thread holding portions on the two edge portions of the plate member while being caught on the rod members. Thus by weaving a thread, which has been inserted through beads, through the threads that have been lined up between the edge portions, a beaded textile can be manufactured.

The task of weaving the thread, which has been inserted through beads, through the threads is performed by passing the thread, which has been inserted through beads, through the space between threads and the curved plate member, while supporting the beads from the bottom with a finger and pushing them up, as described in FIG. 8 and paragraph 0021 of Japanese Patent 4667171. In such a weaving task, the beads need to be supported by a finger, and therefore one hand becomes occupied and unavailable for use. Thus, there has been room for improvement in terms of usability in the above conventional bead weaving tool.

SUMMARY OF THE INVENTION

The present invention was conceived in light of the above-described circumstances, and an object thereof is to provide a bead weaving tool having improved usability in comparison with the above conventional bead weaving tool.

According to an aspect of the invention, there is provided a bead weaving tool including a plate member having a planar bead mounting surface for bead placement and a rear surface opposite to the bead mounting surface. The plate member may include: first and second thread holding portions separated from each other in a first direction parallel to the bead mounting surface for holding a plurality of threads separately in a second direction parallel to the bead mounting surface and perpendicular to the first direction; first and second thread support walls separated from each other in the first direction for supporting the plurality of threads, where the first and second thread support walls are provided on the bead mounting surface so as to protrude in a third direction perpendicular to the bead mounting surface; and first and second thread hanging portions separated from each other in the first direction for hooking one end and the other end of each of the plurality of threads.

Preferably, the plate member is rectangular in shape, and includes first and second end edges parallel to each other and extending in the second direction, and also includes third and fourth end edges parallel to each other and extending in the first direction. The first and the second support walls are positioned between the first and the second thread holding portions as viewed in the third direction. The first and the second thread hanging portions are provided on the rear surface of the plate member.

Preferably, the plate member includes: third and fourth thread holding portions provided at the third and the fourth end edges and configured to hold a plurality of additional threads separately from each other in the first direction; third and fourth thread support walls separated from each other in the second direction for supporting the plurality of additional threads, where the third and fourth thread support walls protrude from the bead mounting surface in the third direction and located between the third and the fourth thread support portions as viewed in the third direction; and third and fourth thread hanging portions separated from each other in the second direction for hooking one end and the other end of each of the plurality of additional threads.

Preferably, the first and the second thread holding portions each include a shaft portion extending in the third direction, and also a flange portion disposed at a tip of the shaft portion and having a larger diameter than the shaft portion.

Preferably, the bead weaving tool of the first aspect may further include a rod-shaped portion formed integral with the flange portion, wherein the shaft portion includes a cylindrical portion extending from the rear surface of the plate member, and the rod-shaped portion is removably inserted into the cylindrical portion.

Preferably, the plate member is an elongated rectangle.

Preferably, the rear surface of the plate member is provided with a plurality of leg portions each extending upright from the rear surface beyond the first and the second thread hanging portions.

Preferably, the rear surface of the plate member is a rectangle having four corners at which the plurality of leg portions are disposed, respectively.

Other features and advantages of the present invention will become apparent from the detailed description given below with reference to the accompanying drawings.

DESCRIPTION OF THE PREFERRED EMBODIMENTS

Figure 1:
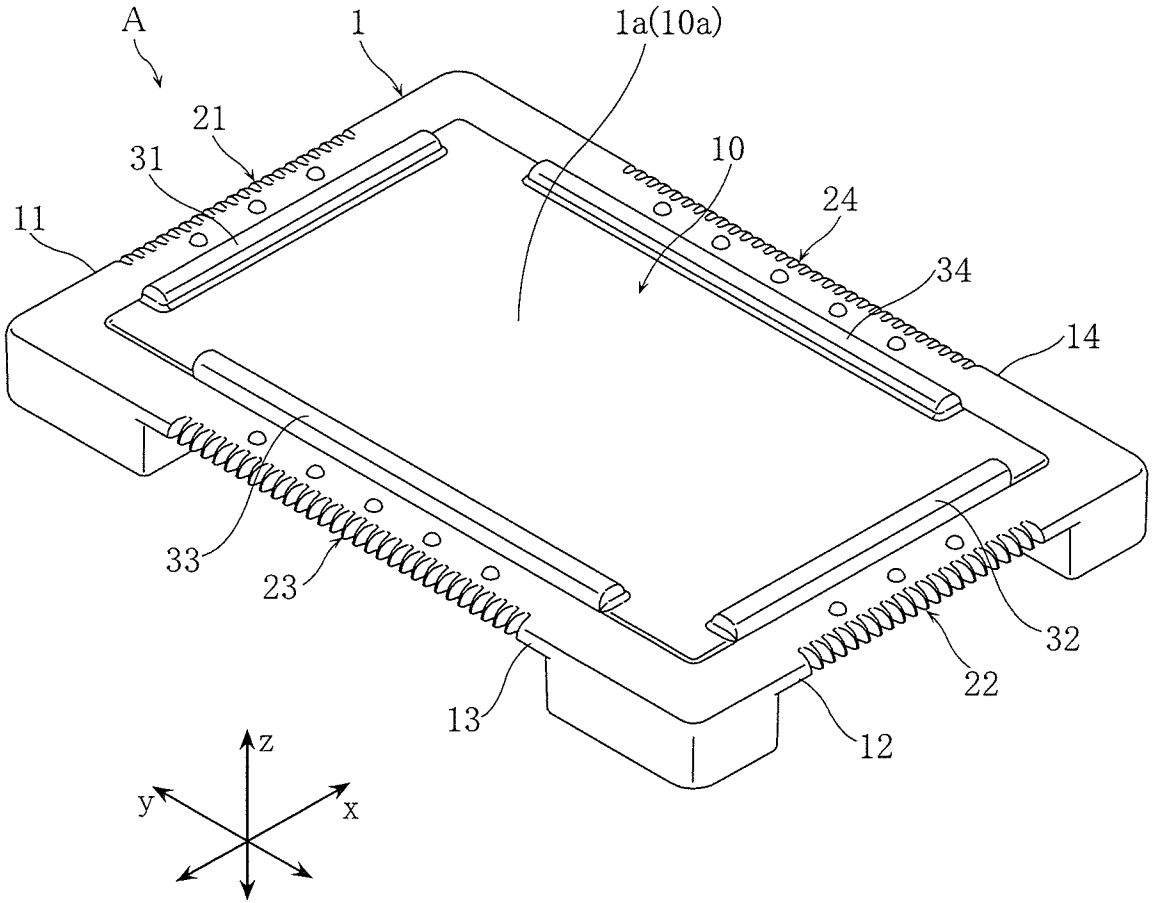
FIG. 1 is a perspective view showing an example of a bead weaving tool according to the present invention.

The following specifically describes preferable embodiments of the present invention with reference to the drawings.

FIGS. 1 to 6 show an embodiment of a bead weaving tool according to the present invention. A bead weaving tool A of the present embodiment includes a flat plate-shaped plate member 1, and is used for manufacturing beaded textiles having beads woven therein.

The plate member 1 has an elongated rectangular main plate portion 10 as viewed in the thickness direction, and is integrally formed with a synthetic resin such as polyacetal. Although described in detail below, an upper surface 1*a* of the plate member 1 (the main plate portion 10) constitutes a planar bead mounting surface 10*a*, which is where beads are to be placed. Note that the plate member 1 is a semi-translucent white or light color, for example, so that the color of the beads can be easily visually confirmed when placed on the bead mounting surface 10*a*.

The outer circumferential edge of the plate member 1 has edge ends 11 and 12 that are parallel to each and extend along a direction x, and edge ends 13 and 14 that are parallel to each other and extend along a direction y. Both of the directions x and y follow are directions following the in-plane direction of the upper-surface 1*a* (the bead mounting surface 10*a*), and the directions x and y are perpendicular to each other. In the present embodiment, the length of the end edges 13 and 14 in the direction y is longer than the length of the end edges 11 and 12 in the direction x.

Thread holding portions 21 and 22 are provided on the end edges 11 and 12 to hold multiple vertical threads apart from each other. The thread holding portion 21 is shaped as a comb with a plurality of protrusion portions 211 lined up along the direction x, and a plurality of groove portions 212 are formed between adjacent protrusion portions 211. The thread holding portion 22 is also shaped as a comb with a plurality of protrusion portions 221 lined up along the direction x, and a plurality of groove portions 222 are formed between adjacent protrusion portions 221. The groove portions 212 and 222 are each lined up along the direction x with a predetermined pitch. The pitch of the groove portions 212 and 222 is approximately 1.5 mm, for example.

Figure 2:
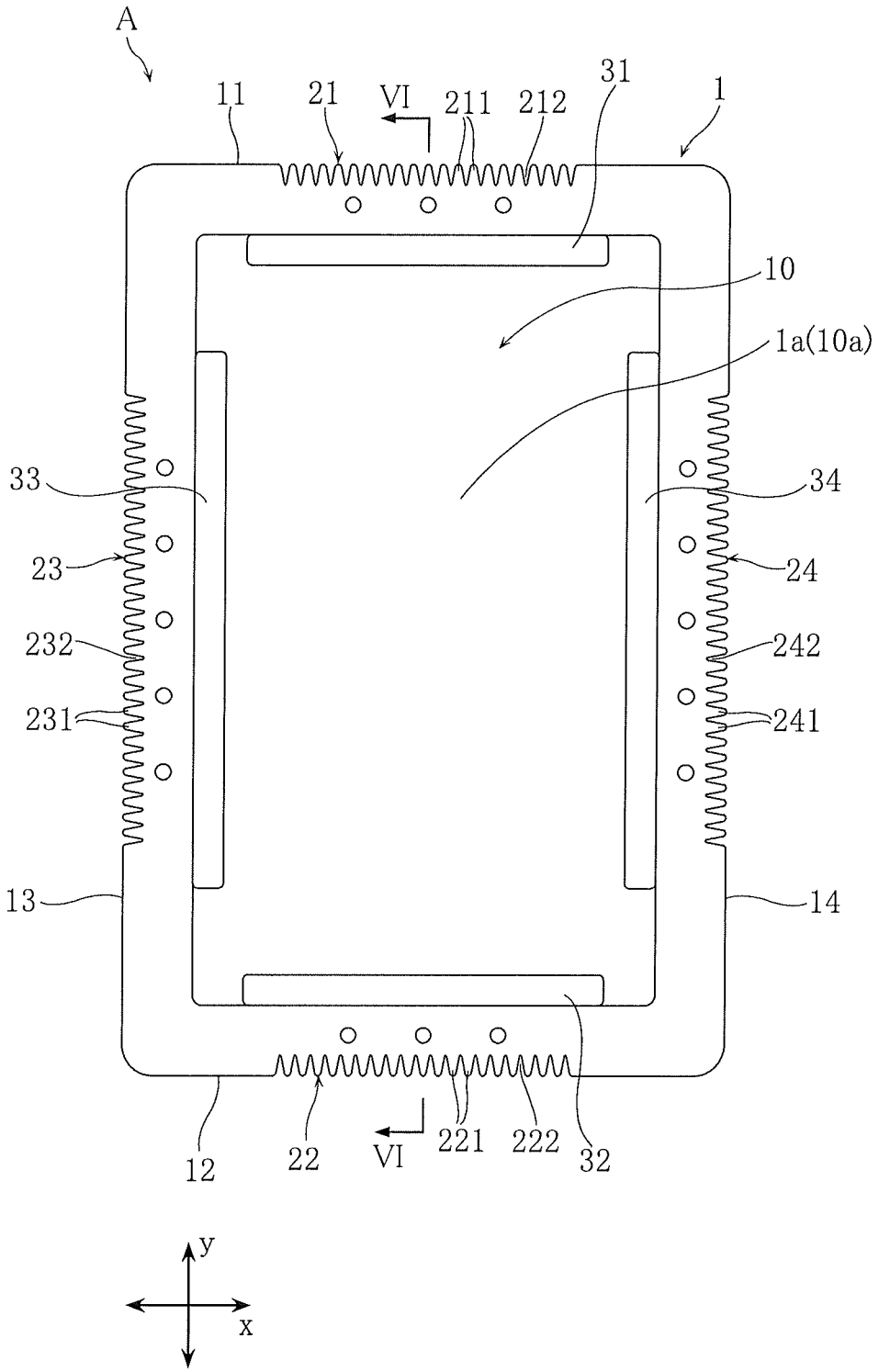
FIG. 2 is a plan view of the bead weaving tool shown in FIG. 1.
Figure 3:
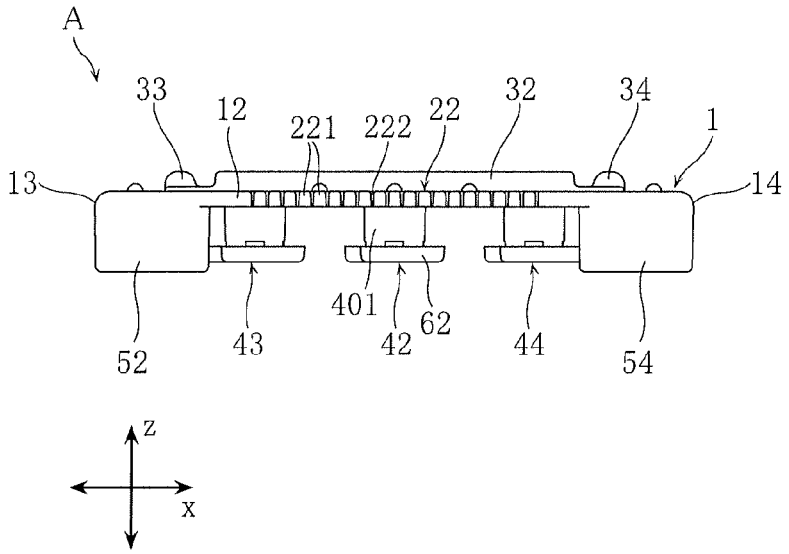
FIG. 3 is a front view of the bead weaving tool shown in FIG. 1.
Figure 4:
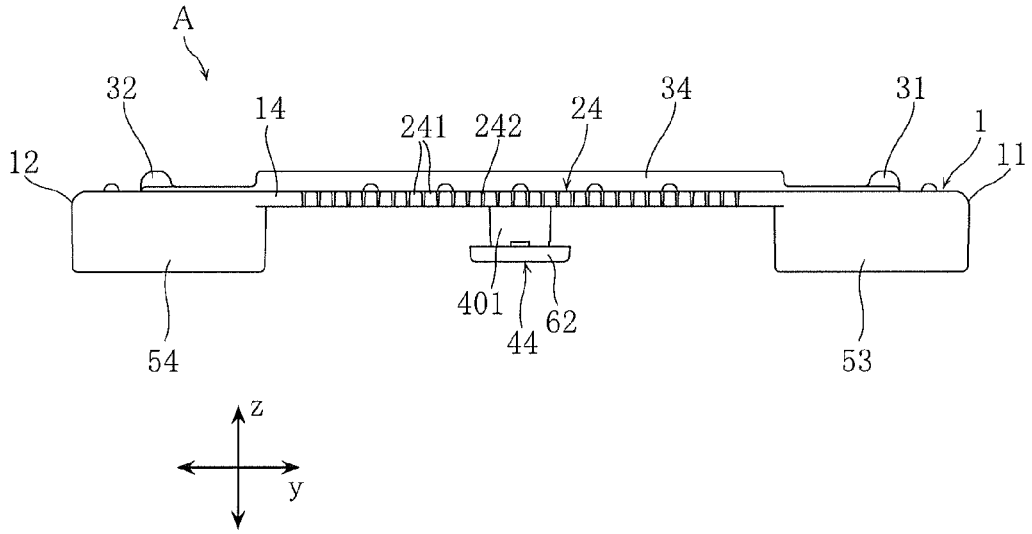
FIG. 4 is a right-side view of the bead weaving tool shown in FIG. 1.

Thread support walls 31 and 32 are provided on the upper surface 1*a* of the plate member 1 (main plate portion 10). The thread support walls 31 and 32 are provided in the vicinity of the thread holding members 21 and 22 respectively. As shown in FIG. 1 and FIG. 3, the thread support walls 31 and 32 each protrude with a constant height in the height direction (a direction z) that is perpendicular to the upper surface 1*a* (the bead mounting face 10*a*), and also extending along the direction x. As shown in FIG. 2, the thread support walls 31 and 32 are positioned between the thread holding members 21 and 22 (end edges 11 and 12) as viewed in the direction x, and the region between the thread support walls 31 and 32 is the bead mounting surface 10*a*. When multiple vertical threads are held with predetermined gaps in the direction x by the thread holding portions 21 and 22, these vertical threads are supported by the thread support walls 31 and 32 with a predetermined gap from the upper surface 1*a* (the bead mounting surface 10*a*) (see FIG. 11).

Thread holding portions 23 and 24 are provided at the end edges 13 and 14 to hold each of the vertical threads apart from each other. The thread holding portion 23 is shaped as a comb with a plurality of protrusion portion portions 231, which are lined up along the direction y, and a plurality of groove portions 232 are formed between the adjacent protrusion portions 231. The thread holding portion 24 is also shaped as a comb with a plurality of protrusion portions 241, which are lined up along the direction y, and a plurality of groove portions 222 are formed between adjacent protrusion portions 241. The groove portions 232 and 242 are lined up at a predetermined pitch along the direction y. The pitch of the groove portions 232 and 242 is approximately 1.5 mm, for example.

Thread support walls 33 and 34 are provided on the upper surface 1*a* of the plate member 1 (main plate portion 10). The thread support walls 33 and 34 are provided in the vicinity of each of the thread holding members 23 and 24. As shown in FIG. 1 or FIG. 3, the thread support walls 33 and 34 each protrude with a constant height in the height direction (a direction y) that is perpendicular to the upper surface 1*a* (the bead mounting face 10*a*), and also extending along the direction y. As shown in FIG. 2, the thread support walls 33 and 34 are positioned between the thread holding members 23 and 24 (end edges 13 and 14) as viewed in the direction z, and the region between the thread support walls 33 and 34 is the bead mounting surface 10*a*. When multiple vertical threads are held with predetermined gaps in the direction x by the thread holding portions 23 and 24, these vertical threads are supported by the thread support walls 33 and 34 with a predetermined gap from the upper surface 1*a* (the bead mounting surface 10*a*) (see FIG. 11).

Figure 5:
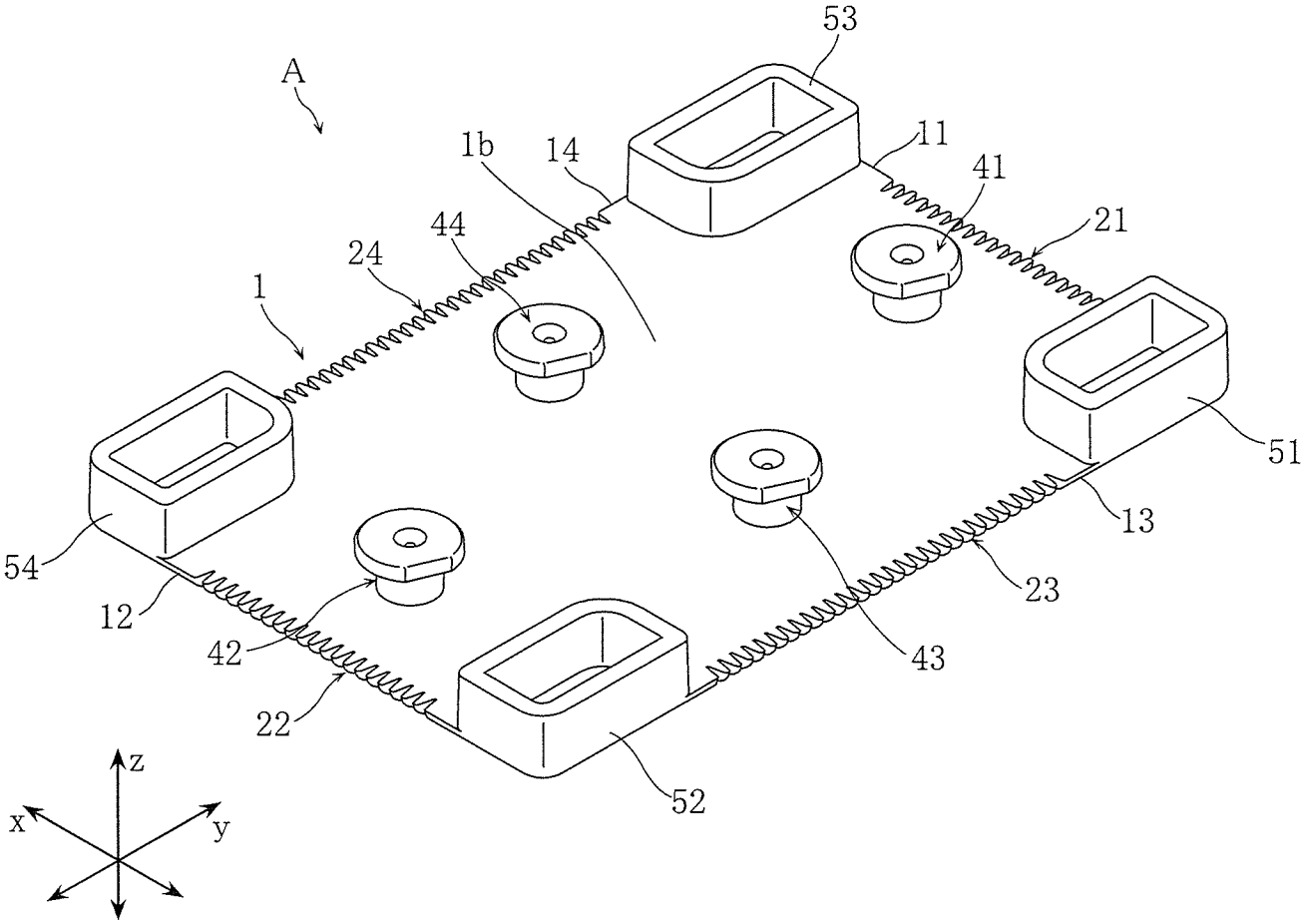
FIG. 5 is a perspective view, as viewed from the lower surface side.

As shown in FIG. 5, a plurality of (four in the present embodiment) thread hanging portions 41, 42, 43, and 44, and a plurality of leg portions 51, 52, 53, and 54 are provided on a lower surface 1B (the surface on the side opposite to the bead mounting surface 10*a*) of the plate member 1 (the main plate portion).

The thread hanging portion 41 is for hooking one end of each of the vertical threads, and is provided in the vicinity of the thread holding portion 21. The thread hanging portion 42 is for hooking the other end of each of the vertical threads, and is provided in the vicinity of the thread holding portion 22. The thread hanging portions 41 and 42 are positioned apart from each other in the direction y.

The thread hanging portion 43 is for hooking one end of each of the vertical threads, and is provided in the vicinity of the thread holding portion 23. The thread hanging portion 44 is for hooking the other end of each of the vertical threads, and is provided in the vicinity of the thread holding portion 24. The thread hanging portions 43 and 44 are positioned apart from each other in the direction x.

Next is a description of the structure of the thread hanging portions 41 to 44. The four thread hanging portions 41 to 44 have the same structure, and therefore the structure of the thread hanging portion 41 is described below as a representative example.

Figure 6:
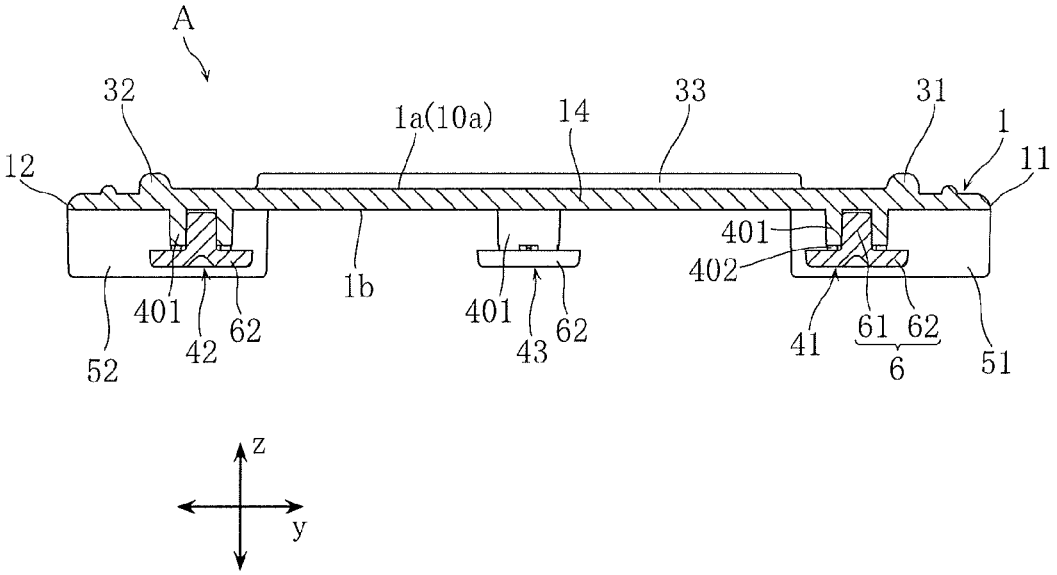
FIG. 6 is a partial cross-sectional view taken along the VI-VI line in FIG. 2.

As shown in FIG. 6, the thread hanging portion 41 is configured including a cylindrical portion 401 and a button member 6 that is attached to the cylindrical portion 401. The cylindrical portion 401 extends from the lower surface 1*b* in the direction z. The button member 6 has a rod-shaped portion 61 and a flange portion 62 that is provided at the tip of the rod-shaped portion 61. The outer diameter dimension of the rod-shaped portion 61 is slightly smaller than the inner diameter dimension of the cylindrical portion 401, and the rod-shaped portion 61 is inserted into the cylindrical portion 401 so as to be attachable and detachable.

The outer diameter dimension of the flange portion 62 is larger than the outer diameter dimension of the cylindrical member 401. In a state in which the rod-shaped portion 61 has been inserted into the cylindrical portion 401 (a state in which the button member 6 is attached), the flange portion 62, which has a diameter larger than that of the cylindrical portion 401, is located on the tip of the cylindrical portion 401. Note that as understood from FIGS. 3, 4, 6 and the like, cross-shaped recessed grooves 402 that extend along the diameter direction of the cylindrical portion 401 are formed at the tip of the cylindrical portion 401.

The leg portions 51 to 54 extend from the lower surface 1*b* in the direction z in the four corners of the plate member 1. Each of the leg portions 51 to 54 is a rectangular tube, and the tips of leg portions 51 to 54 are located at positions farther away from the lower surface 1*b* than the tips of the thread hanging portions 41 to 44 (flange portions 62).

To give one example of the dimensions of the portions of the bead weaving tool A, the plate member 1 (the main plate portion 10) has a thickness of approximately 1 to 3 mm, the end edges 11 and 12 have a length of approximately 6 cm in the direction x, and the end edges 13 and 14 have a length of approximately 9 cm in the direction y. The length of the thread holding portions 21 and 22 in the direction x is approximately 3 cm, and the length of the thread holding portions 23 and 24 in the direction y is approximately 4.5 cm. The length of the thread support walls 31 and 32 in the direction x is approximately 3.5 cm, and the length of the thread support walls 33 and 34 in the direction y is approximately 5.2 cm.

The height of the thread supporting walls 31 to 34 in the direction z from the bead mounting surface is approximately 1 to 2 mm.

Next is a description of a method for performing the task of bead weaving using the bead weaving tool A with reference to FIGS. 7 to 12.

Figure 7:
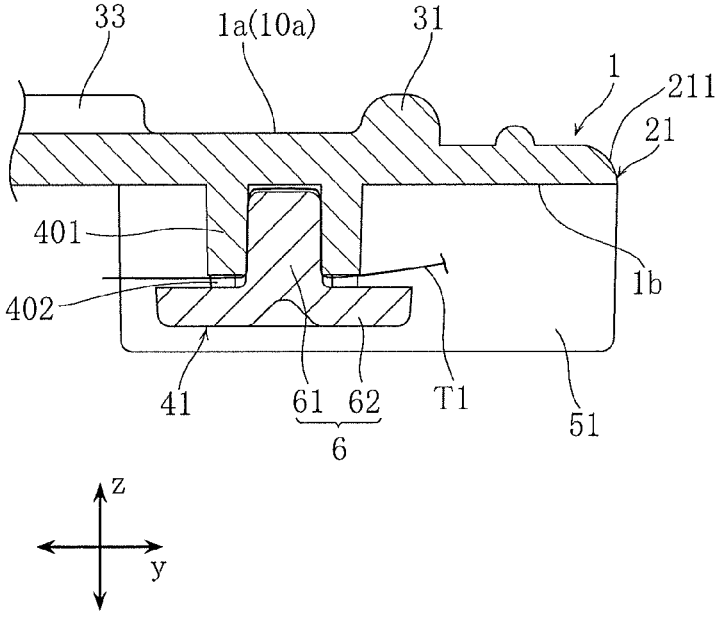
FIG. 7 is a cross-sectional view of the main components for describing a method of use of the bead weaving.
Figure 8:
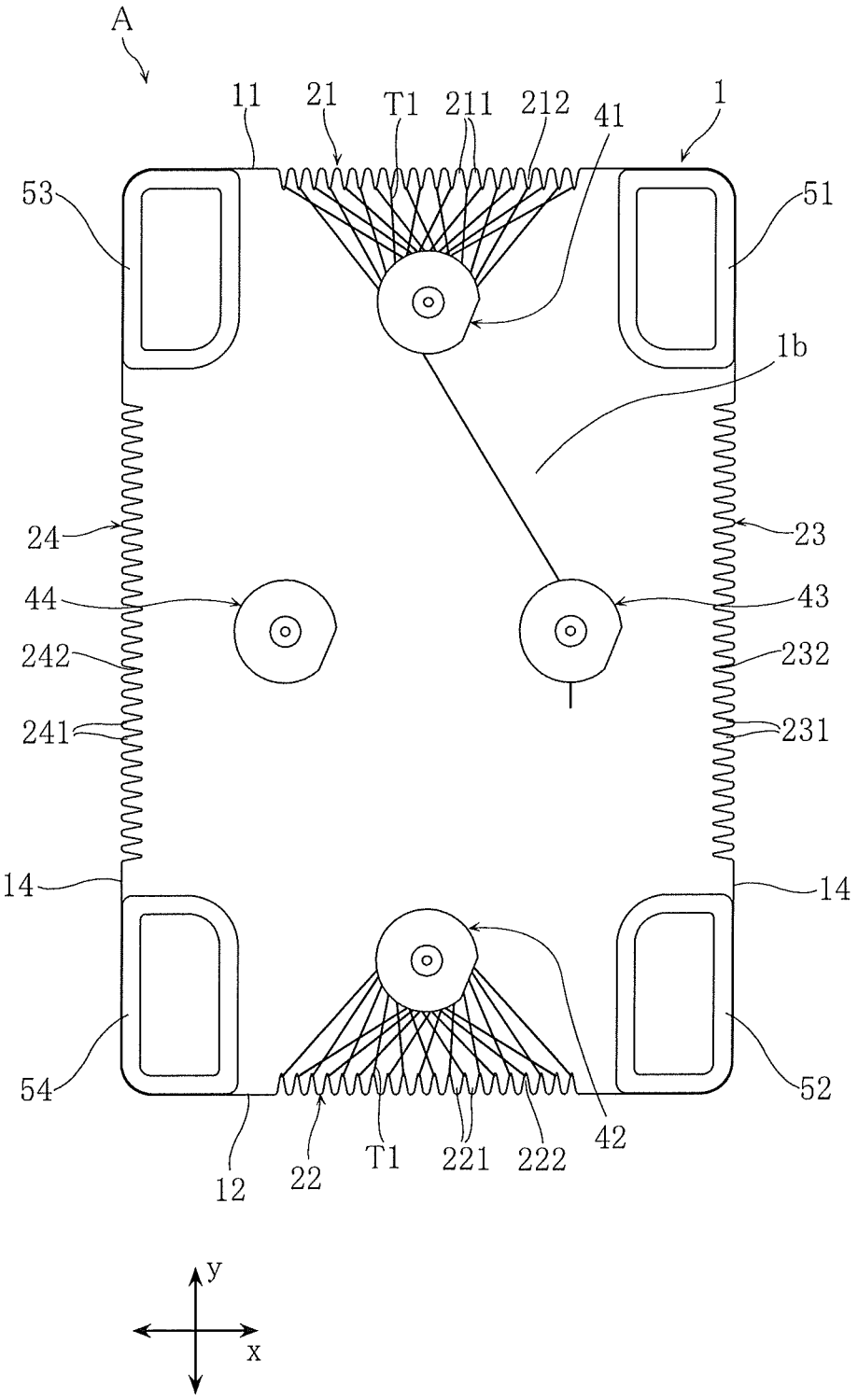
FIG. 8 is a bottom plan view for describing a method of use of the bead weaving tool.

This is a description of the case where vertical threads are strung between the thread supporting walls 31 and 32. First, in this case, one end of a thread is fixed to the thread hanging portion 41. Specifically, the plate member 1 is turned over, the button member 6 is removed, and the one end (thread end) of a thread is placed in one recessed groove 402 in the tip of the cylindrical portion 401 so as to pass through the center of the cylindrical portion 401 and follow the diameter direction. Next, the rod-shaped portion 61 is inserted into the cylindrical portion 401 along with the thread end. Accordingly, as shown in FIG. 7, the thread end is sandwiched between the rod-shaped portion 61 and the cylindrical portion 401, and is thus fixed to the thread hanging portion 41.

Figure 9:
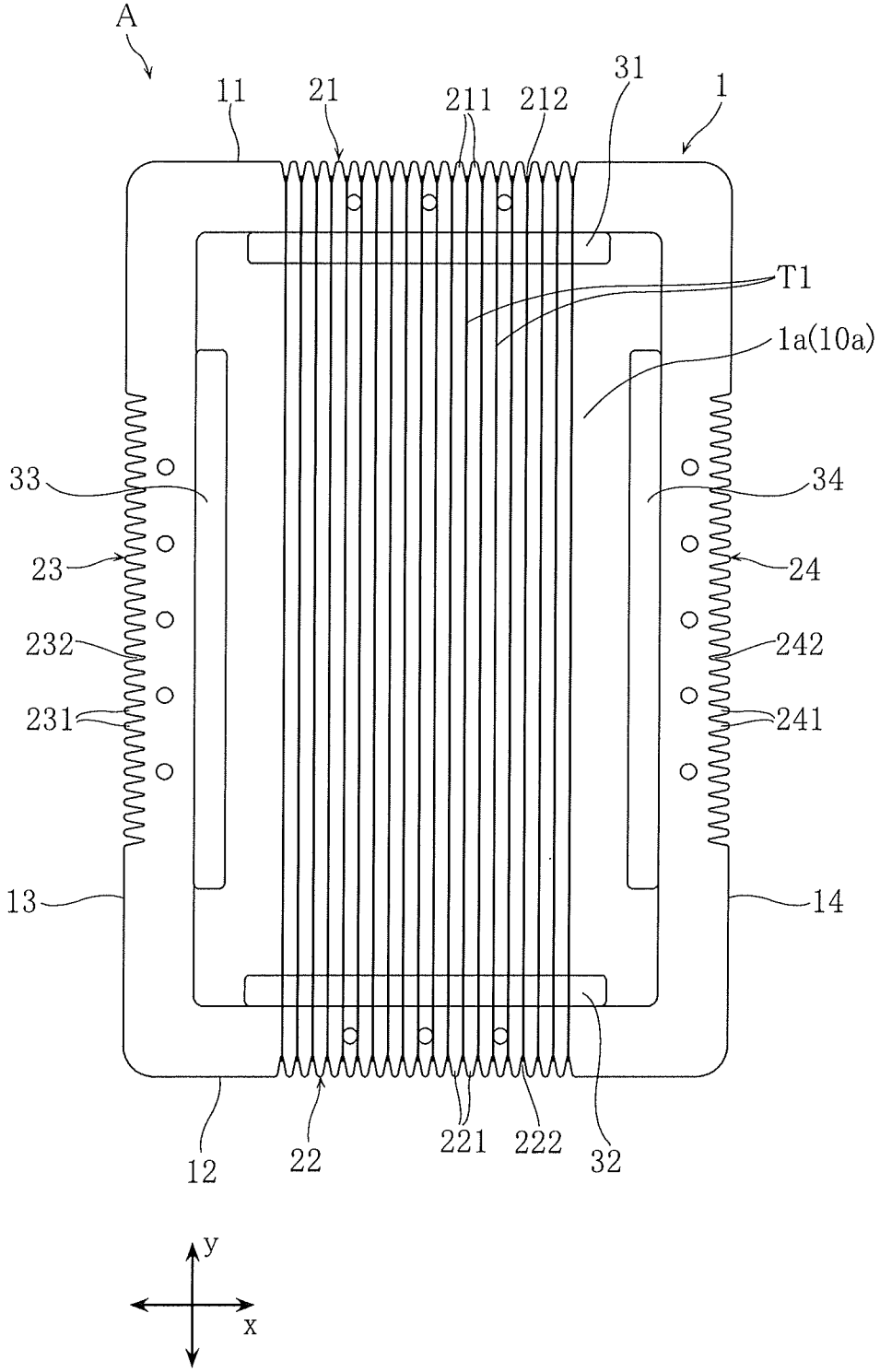
FIG. 9 is a plan view for describing a method of use of the bead weaving tool.
Figure 10:
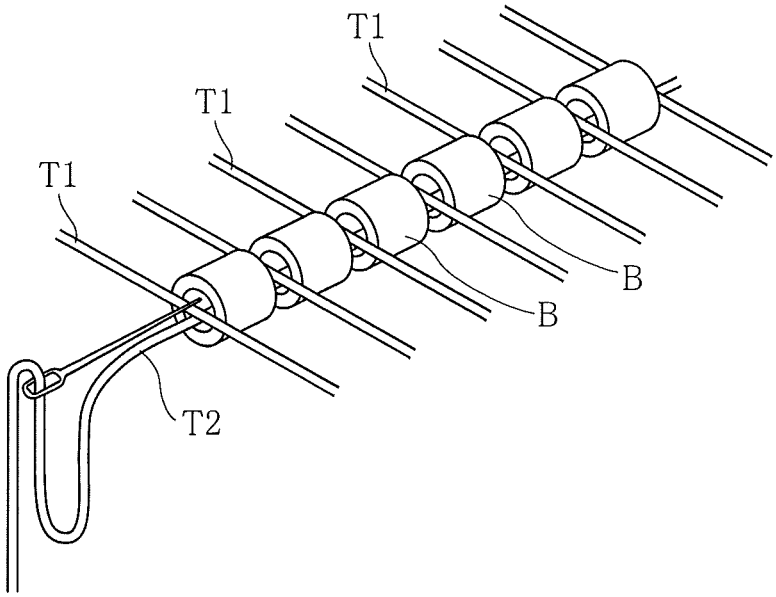
FIG. 10 is a perspective view for describing a bead weaving procedure.

Next, the thread is fitted into a groove portion 212 of the thread holding portion 21, then extended in the direction y on the upper surface 1*a* side of the plate member 1, and fitted into a groove portion 222 of the thread holding portion 22. Then, the thread is hooked around the thread hanging portion 42 (the cylindrical portion 401) on the lower surface 1*b* side, and then fitted into the groove portion 222 that is adjacent to the groove portion 222 in which that thread is already fitted. Next, the thread is extended in the direction y on the upper surface 1*a* side, and then fitted into a groove portion 212 of the thread holding portion 21. Next, the thread is hooked around the thread hanging portion 41 (the cylindrical portion 401) on the lower surface 1*b* side, and then fitted into the groove portion 212 that is adjacent to the groove portion 212 into which that thread is already fitted. This task is repeated, and then the thread is fixed to either the thread hanging portion 43 or 44 on the lower surface 1*b* side (see FIG. 8), for example. In this way, a plurality of vertical threads T1 are held lined up with equal gaps in the direction x by the thread holding portions 21 and 22, as shown in FIG. 9. Also, the vertical threads T1 are supported by the thread support walls 31 and 32, and the vertical threads T1 between the thread supporting walls 31 and 32 are separated from the bead mounting surface 10*a* at a height corresponding to the height of the thread supporting walls 31 and 32 in the direction z (approximately 1 to 2 mm).

Figure 11:
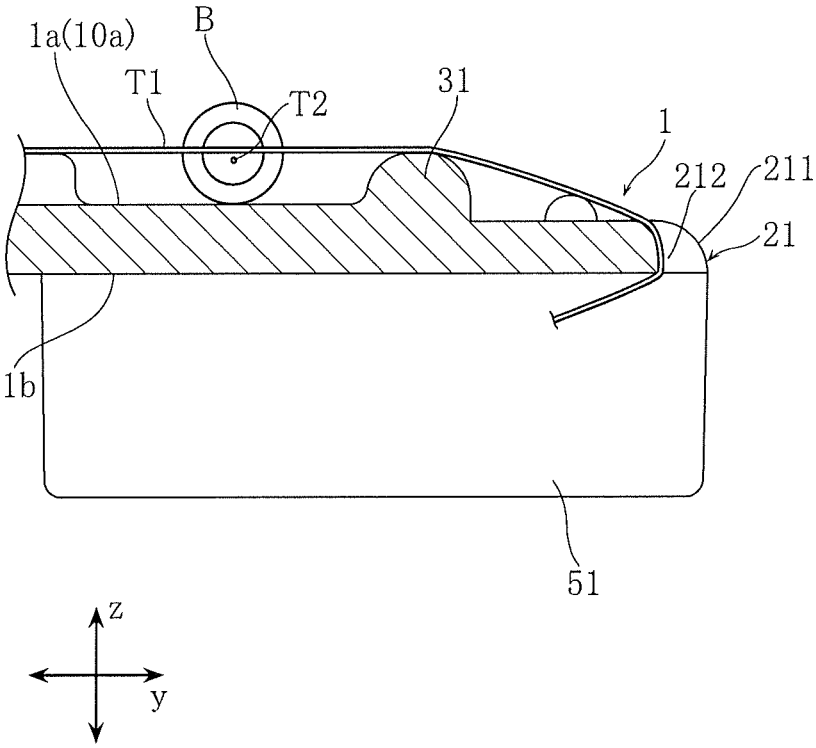
FIG. 11 is a cross-sectional view of main portions for describing a method of use of the bead weaving tool.

Next, a horizontal thread that has been inserted through beads from the needle tip is woven into the vertical threads. At this point, a member such as a rod member (not shown) is used to slightly lift up the vertical threads T1, and a horizontal thread T2 and beads B are passed under the vertical threads T1 so as to traverse the vertical threads T1 (see FIG. 10), and the beads B are placed on the bead mounting surface 10*a*. Next, the vertical threads T1 are returned to their original position, and the beads B are respectively placed between adjacent vertical threads T1. At this time, as shown in FIG. 11, the beads B are supported by the bead mounting face 10*a*. Also, the vertical threads T1 are in the vicinity of the center of the beads B in the diameter direction.

Figure 12:
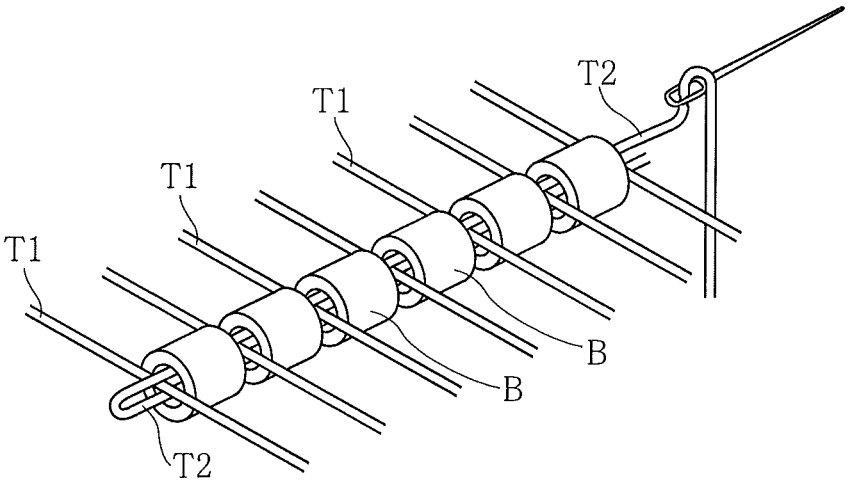
FIG. 12 is a perspective view for describing the bead weaving procedure.

Next, as shown in FIG. 12, the horizontal thread T2 is turned back at the vertical, thread T1 at one end in the direction x, and then passed through the holes of the beads B so as to pass over the vertical threads T1. In this way, two horizontal threads T2 are passed through each of the beads B, and the vertical threads T1 are sandwiched from above and below by the two horizontal threads T2. Next, the horizontal thread T2 is inserted into beads B from the needle tip, and this horizontal thread is again turned back at the vertical thread located at the other end in the direction y. Then, as described above, the vertical threads T1 are slightly lifted up, the horizontal thread T2 and the beads B are passed under the vertical threads T1 so as to traverse the vertical threads T1, and the beads B are placed on the bead mounting surface 10*a*. Next, the beads B are respectively placed between adjacent vertical threads T1. By repeating this operation a predetermined number of times, a beaded textile having a predetermined length in the direction y, in which the vertical threads T1 extend, is manufactured.

Next, the button members 6 are removed from the cylindrical portion 401 in the thread hanging portions 41, 42, 43 (44), and the threads that were wound around the cylindrical portions 401 (the vertical thread T1) are removed. Then, by pulling the two ends of the vertical thread T1, the portions that were wound around the thread hanging portions 41 and 42 pass through the beads B, thus completing the process.

Also in the case where vertical threads are strung between the thread support walls 33 and 34, a beaded textile can be manufactured by following the same order as the above case, in which vertical threads are strung between the thread support walls 31 and 32. Specifically, in the case where vertical threads are strung between the thread supporting walls 33 and 34, the vertical threads T1 are lined up with equal gaps in the direction y by the thread holding portions 23 and 24, and hooked around the thread hanging portions 43 and 44. Also, the vertical threads are separated by a predetermined gap from the bead mounting surface 1*a* by the thread mounting walls 34 and 34.

Next, is a description of effects of the bead weaving tool A.

According to the bead weaving tool A of the present embodiment, the vertical threads T1 are held with equal gaps by the thread holding portions 21 and 22 provided at the end edges 11 and 12, and these vertical threads T1 are supported by the thread support walls 31 and 32 spaced apart in the direction y. Here, the vertical threads T1 are positioned away from the bead mounting surface 10*a* at a height that corresponds to the height of the thread support walls 31 and 32. For this reason, when performing the bead weaving task, the beads B are respectively placed between adjacent vertical threads T1 in a state of being placed on the bead mounting surface 10*a*, as is also comprehended from the description referring to FIG. 11. According to this configuration, after the horizontal thread T2 has traversed the underside of the vertical threads T1, there is no requirement to lift up the beads B from below, therefore leaving the user's hands free. Accordingly, an improvement to the workability at the time of bead weaving can be realized.

The thread holding portions 21 and 22 (23 and 24) are provided at the end edges 11 and 12 of the rectangular-shaped plate member 1, and the thread hanging portions 41 and 42 (43 and 44) are provided on the lower surface 1*b*, which is on the side opposite to the upper surface 1*a* (the bead mounting surface 10*a*), on which the thread support walls 31 and 32 (33 and 34) are provided. According to this configuration in which the thread hanging portions 41 and 42 (43 and 44) are provided on the lower surface 1*b*, it is possible to reduce the overall size of the plate member 1 (the bead weaving tool A). Also, the bead weaving tool A is a card type and suitable for carrying.

The leg portions 51 to 54, which extend to a position father away from the lower surface 1*b* than the tips of the thread hanging portions 41 to 44 are, are provided on each of the four corners of the lower surface 1*b* of the plate member. According to this configuration, in the case where, for example, the plate member 1 (bead weaving tool A) is placed on a desk and the task of bead weaving is performed, the thread hanging portions 41 to 44 on the side of the lower surface 1*b* never directly touch the table. Also, the bead weaving tool A can be placed on the desk in a stabilized state via the leg portions 51 to 54, and therefore the bead weaving task can be easily performed.

Each of the thread hanging portions 41 to 44 includes a cylindrical member 401 (a shaft portion) that extends in the direction z, and a large-diameter flange portion 62 that is positioned at the tip of the cylindrical portion 401. According to this configuration, the vertical thread T1 that has been wound around a cylindrical portion 401 is locked by the flange portion 62 even if the vertical thread T1 shifts to the tip side of that cylindrical portion 401. Accordingly, the unintended removal of the vertical thread T1 hung around the thread hanging portion 41 is prevented.

Each of the thread hanging portions 41 to 44, includes the button member 6 that has the rod-shaped portion 61 and the flange portion 62, and the button member 6 is attached to the cylindrical member 401 by inserting the rod-shaped portion 61 into the cylindrical portion 401. According to this configuration, when performing the task of stringing vertical threads for example, by inserting the thread end into the cylindrical portion 401 along with the rod member 61, the thread end can be fixed to the thread hanging portion 41. Also, recessed grooves 402 that follow the diameter direction are provided in the tip of the cylindrical member 401. Accordingly, when fixing the thread end, by placing the thread in a recessed groove 402 so as to pass through the center of the cylindrical portion 401 and follow the diameter direction, the thread end can be easily fixed to the thread hanging portion 41 (42 to 44).

The thread holding portions 23 and 24 are provided at the end edges 13 and 14, which are longer than the end edges 11 and 12, on the plate member 1 (main plate 10), along with the thread supporting walls 33 and 34 and the thread hanging portions 43 and 44 that correspond to the thread holding portions 23 and 24. The length of the thread holding portions 33 and 34 in the direction y is longer than the length of the thread holding portions 21 and 22 in the direction x. For this reason, by using the thread holding portions 23 and 24 to string the vertical threads, it is possible to manufacture a beaded textile with a different size from the case where the thread holding portions 21 and 22 are used.

Although a specific embodiment of the present invention is described above, the present invention is not limited to the above embodiment, and various changes that do not deviate from the idea of the present invention are possible. The specific shapes, materials, and the like of the bead weaving tool of the present invention are not limited to the above embodiment.

The case in which the thread holding portions 21 and 22 (23 and 24) are provided at the end edges 11 and 12 (13 and 14) is described in the above embodiment, but the thread holding portions may be provided on the tips of the thread support walls in the direction z (height direction). In the case where the thread holding portions are provided on the tips of the thread holding walls in the height direction, the thread holding portions will overlap with the thread support wall as viewed in the direction z, and the thread hanging portions may be provided between the corresponding thread support walls and end edges on the upper surface 1*a* of the plate member 1.

The invention claimed is:

1. A bead weaving tool comprising:

a plate member having a planar bead mounting surface for bead placement and a rear surface opposite to the bead mounting surface, wherein the plate member includes:

first and second thread holding portions separated from each other in a first direction parallel to the bead mounting surface for holding a plurality of threads separately in a second direction parallel to the bead mounting surface and perpendicular to the first direction;

first and second thread support walls separated from each other in the first direction for supporting the plurality of threads, the first and second thread support walls being provided on the bead mounting surface so as to protrude in a third direction perpendicular to the bead mounting surface; and first and second thread hanging portions separated from each other in the first direction for hooking one end and another end of each of the plurality of threads, wherein the plate member is rectangular in shape, and includes first and second end edges parallel to each other and extending in the second direction, and also third and fourth end edges parallel to each other and extending in the first direction, the first and the second support walls are positioned between the first and the second thread holding portions as viewed in the third direction, and the first and the second thread hanging portions are provided on the rear surface of the plate member.

2. The bead weaving tool according to claim 1, wherein the plate member includes:

third and fourth thread holding portions provided at the third and the fourth end edges and configured to hold a plurality of additional threads separately from each other in the first direction;

third and fourth thread support walls separated from each other in the second direction for supporting the plurality of additional threads, the third and fourth thread support walls protruding from the bead mounting surface in the third direction and located between the third and the fourth thread support portions as viewed in the third direction; and third and fourth thread hanging portions separated from each other in the second direction for hooking one end and another end of each of the plurality of additional threads.

3. The bead weaving tool according to claim 1, wherein the first and the second thread holding portions each include a shaft portion extending in the third direction, and a flange portion disposed at a tip of the shaft portion and having a larger diameter than the shaft portion.

4. The bead weaving tool according to claim 3, further comprising a rod-shaped portion formed with the flange portion, wherein the shaft portion includes a cylindrical portion extending from the rear surface of the plate member, the rod-shaped portion being removably inserted into the cylindrical portion.

5. The bead weaving tool according to claim 2, wherein the plate member is an elongated rectangle.

6. The bead weaving tool according to claim 1, wherein the rear surface of the plate member is provided with a plurality of leg portions each extending from the rear surface beyond the first and the second thread hanging portions.

7. The bead weaving tool according to claim 6, wherein the rear surface of the plate member is a rectangle having four corners at which the plurality of leg portions are disposed, respectively.

* * * * *